US007740059B1

(12) United States Patent
Spencer

(10) Patent No.: US 7,740,059 B1
(45) Date of Patent: Jun. 22, 2010

(54) WELL CASING PERFORATOR

(76) Inventor: William A. Spencer, 7512 Mackenzie Dr. Northeast, Rio Rancho, NM (US) 87144

( * ) Notice: Subject to any disclaimer, the term of this patent is extended or adjusted under 35 U.S.C. 154(b) by 0 days.

(21) Appl. No.: 12/551,082

(22) Filed: Aug. 31, 2009

Related U.S. Application Data

(60) Provisional application No. 61/191,424, filed on Sep. 9, 2008.

(51) Int. Cl.
*E21B 43/112* (2006.01)

(52) U.S. Cl. ..... 166/55.2; 166/55.3

(58) Field of Classification Search ..... 166/298, 166/55.2, 55.3
See application file for complete search history.

(56) References Cited

U.S. PATENT DOCUMENTS

| | | | | |
|---|---|---|---|---|
| 1,779,652 | A | 10/1930 | Wood | |
| 2,227,347 | A * | 12/1940 | Johnson | 166/55.3 |
| 2,328,782 | A | 9/1943 | Bynum | |
| 2,753,935 | A * | 7/1956 | Fredd | 166/55.2 |
| 4,106,561 | A | 8/1978 | Jerome et al. | |
| 4,113,314 | A | 9/1978 | Savanick et al. | |
| 4,119,148 | A | 10/1978 | Deardorf | |
| 4,119,151 | A * | 10/1978 | Smith | 166/298 |
| 4,153,118 | A | 5/1979 | Hart | |
| 4,165,784 | A | 8/1979 | Gardner | |
| 4,183,418 | A | 1/1980 | Dudas | |
| 4,220,201 | A * | 9/1980 | Hauk | 166/55.2 |
| 4,392,527 | A * | 7/1983 | Hauk et al. | 166/55.2 |
| 5,701,958 | A | 12/1997 | Braziel | |
| 2003/0070811 | A1 | 4/2003 | Robison et al. | |

* cited by examiner

*Primary Examiner*—William P Neuder
(74) *Attorney, Agent, or Firm*—Neustel Law Offices

(57) ABSTRACT

A well casing perforator for efficiently recovering available water in a previously drilled well by perforating the well casing. The well casing perforator generally includes a frame adapted to be inserted within a well casing and move in a direction parallel to a central longitudinal axis of the well casing, at least one perforator pivotally connected to the frame and including a plurality of spikes extending therefrom for engagement with the well casing and at least one spring to impart a bias force upon the perforator so that the spikes automatically grab the well casing and rotate through the well casing with a change in directional movement of the frame.

10 Claims, 17 Drawing Sheets

WELL CASING PERFORATOR

CROSS REFERENCE TO RELATED APPLICATIONS

I hereby claim benefit under Title 35, United States Code, Section 119(e) of U.S. provisional patent application Ser. No. 61/191,424 filed Sep. 9, 2008. The 61/191,424 application is currently pending. The 61/191,424 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a well and more specifically it relates to a well casing perforator for efficiently recovering available water in a previously drilled well by perforating the well casing.

2. Description of the Related Art

Any discussion of the related art throughout the specification should in no way be considered as an admission that such related art is widely known or forms part of common general knowledge in the field.

Wells are used by many individuals as a means to provide water. Over time, the holes or perforations in the well casing can become clogged due to settling of the surrounding dirt or material among other causes. This can substantially slow or stop the flow of water through the well, which forces the individual to drill a new well. This can be a costly and time consuming process, wherein the individual is generally without running water during this time. Because of the inherent problems with the related art, there is a need for a new and improved well casing perforator for efficiently recovering available water in a previously drilled well by perforating the well casing.

BRIEF SUMMARY OF THE INVENTION

A system for efficiently recovering available water in a previously drilled well by perforating the well casing. The invention generally relates to a well perforator which includes a frame adapted to be inserted within a well casing and move in a direction parallel to a central longitudinal axis of the well casing, at least one perforator pivotally connected to the frame and including a plurality of spikes extending therefrom for engagement with the well casing and at least one spring to impart a bias force upon the perforator so that the spikes automatically grab the well casing and rotate through the well casing with a change in directional movement of the frame.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
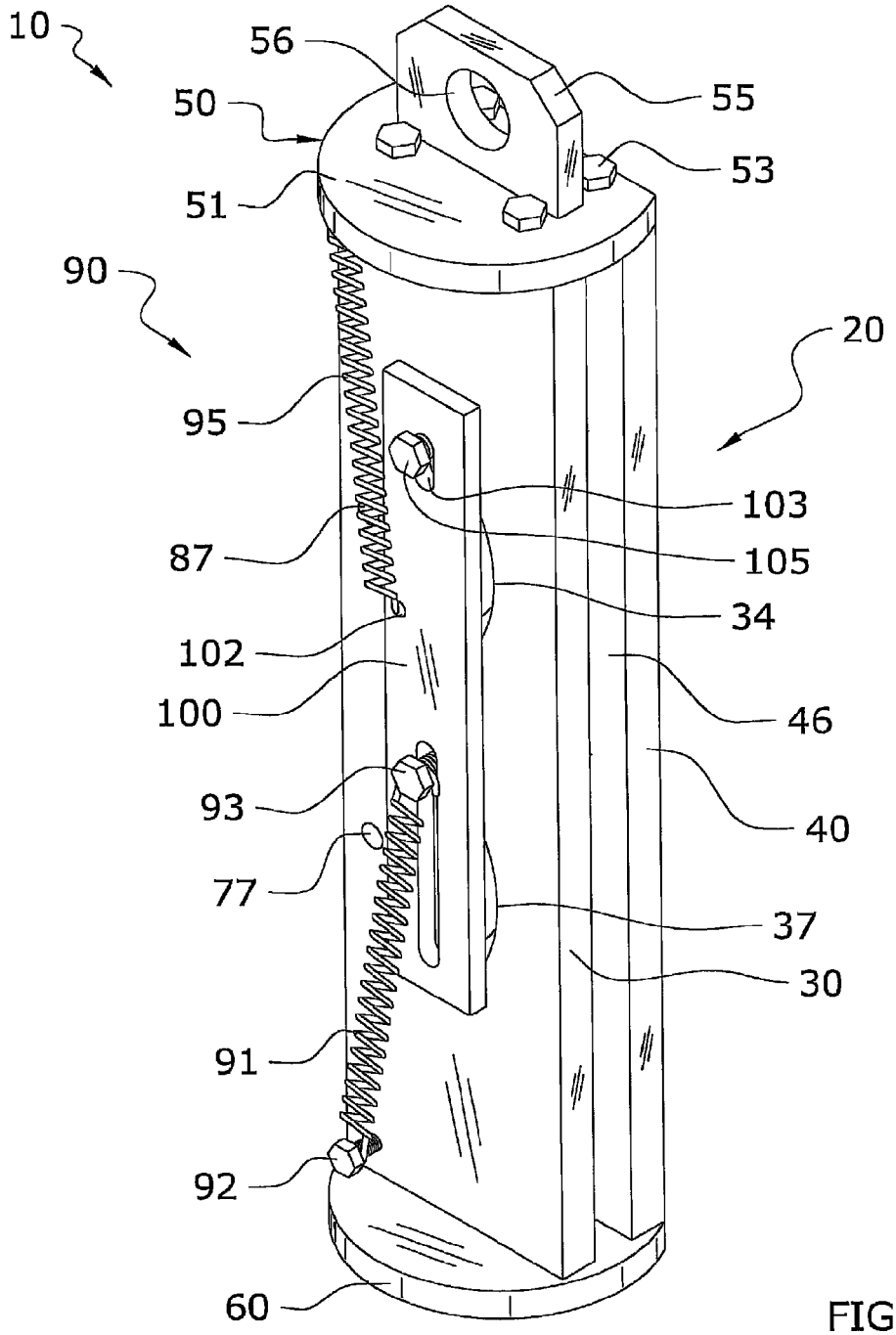
FIG. 1 is an upper perspective view of the present invention.
Figure 2:
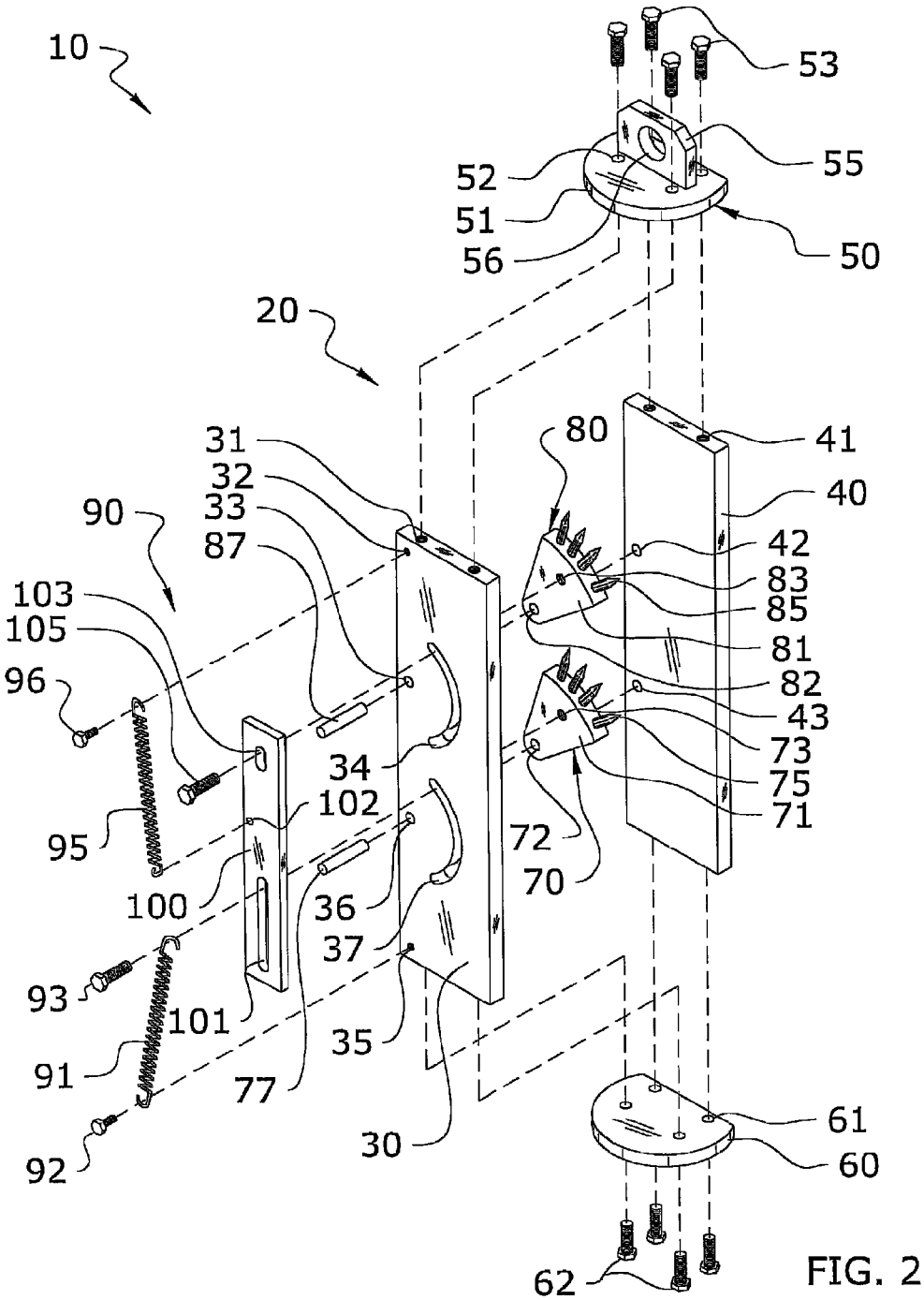
FIG. 2 is an exploded upper perspective view of the present invention.

Turning now descriptively to the drawings, in which similar reference characters denote similar elements throughout the several views, FIGS. 1 through 17 illustrate a well casing perforator 10, which comprises a frame 20 adapted to be inserted within a well casing 12 and move in a direction parallel to a central longitudinal axis of the well casing 12, at least one perforator 70, 80 pivotally connected to the frame 20 and including a plurality of spikes 75, 85 extending therefrom for engagement with the well casing 12 and at least one spring 91, 95 to impart a bias force upon the perforator 70, 80 so that the spikes 75, 85 automatically grab the well casing 12 and rotate through the well casing 12 with a change in directional movement of the frame 20.

B. Frame

The frame 20 is generally comprised of an elongated structure that is insertable within a well casing 12, such as a poly vinyl chloride well casing positioned within a well bore. The frame 20 is elongated so as to retain a vertical orientation when the well casing 12 is being perforated. The frame 20 is also able to be rotated within the well casing 12 so as to be able to perforate multiple sides of the well casing 12. The frame 20 moves parallel with a central longitudinal axis of the well casing 12 and is preferably concentric with the well casing 12.

The frame 20 may be comprised of various structures. In the preferred embodiment, the frame 20 includes a first side plate 30 and a spaced apart second side plate 40, wherein the perforators 70, 80 are positioned between thereof. The first side plate 30 and the second side plate 40 form at least one slot 46 extending between thereof for the perforators 70, 80 to extend through when engaging and piercing the well casing 12. The first side plate 30 and the second side plate 40 are similar in size and shape and are further each preferably comprised of a rectangular shaped structure.

The first side plate 30 also includes multiple openings 32, 35 for connecting springs 91, 95 thereto and multiple openings 33, 34, 36, 37 for connecting the perforators 70, 80 thereto. The second side plate 40 also includes aligned openings 42, 43 for connecting the perforator. The openings 32, 35 for the springs 91, 95 are preferably each positioned in opposing upper and lower corners of the first side plate 30. More specifically, the first side plate 30 further includes multiple curved slots 34, 37 in which the perforators 70, 80 are guided when rotating through the well casing 12. The curved slots 34, 37 are similar in shape and are positioned above and below each other.

Both the first side plate 30 and the second side plate 40 include upper openings 31, 41 to receive fasteners 53 for attaching an upper support 50 and lower openings (not shown) to receive fasteners 62 for attaching a lower support 60. The upper openings 41 and the lower openings may be threadably formed to threadably receive the fasteners 53, 62. The fasteners 53, 62 may be comprised of bolts or various other structures.

The upper support 50 generally includes a top plate 51 in which a plurality of openings 52 extend therethrough for receiving the fasteners 53 and aligning with the upper openings 31, 41 of the side plates 30, 40 and a connector element 55 extending vertically upward therefrom. The connector element 55 includes an opening 56 extending therethrough for connection to an elongated member 16 responsible for imparting vertical movement upon the frame 20 when within the well casing 12.

Figure 14:
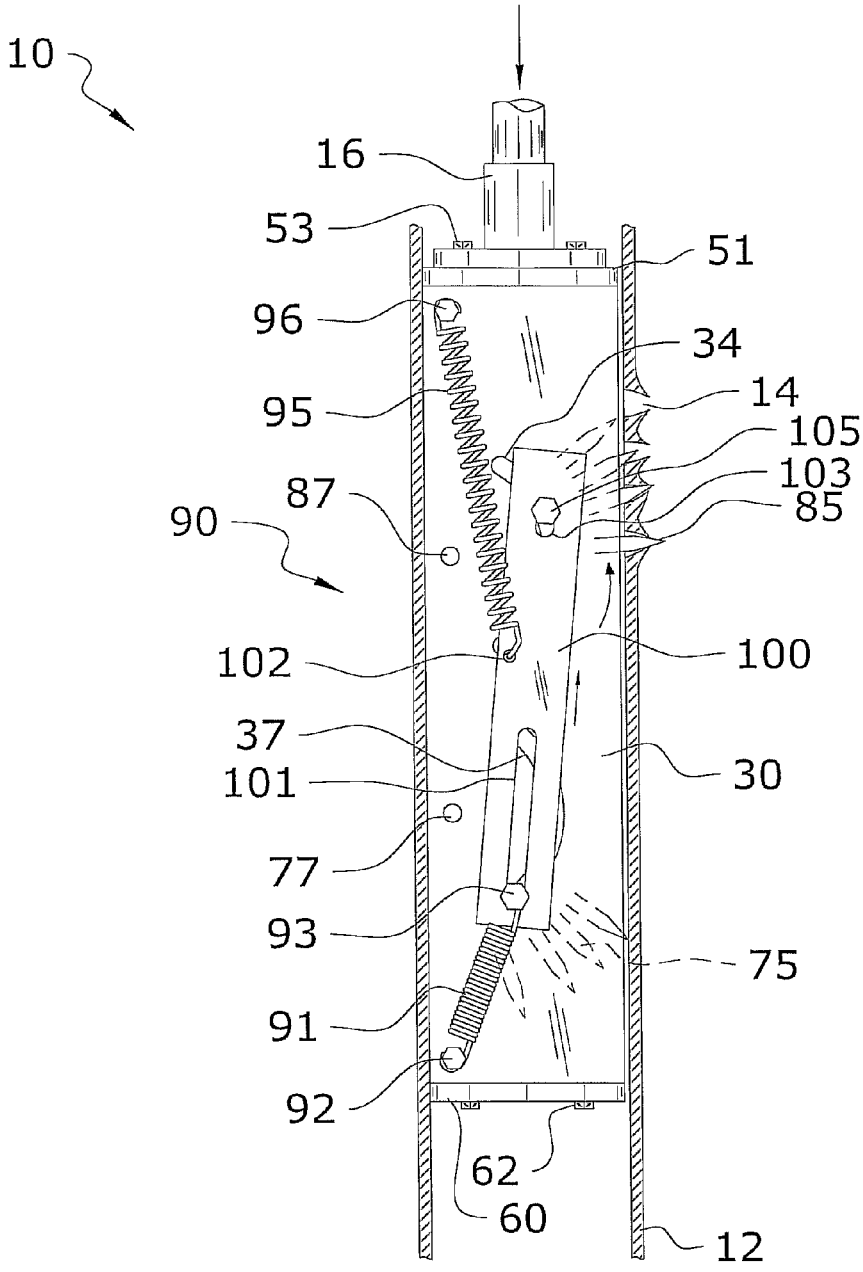
FIG. 14 is a side view of an alternate embodiment of the present invention using a drill rig to impart a downward force and illustrating the downward directional force causing the upper perforator to form a first set of perforations in the well casing.
Figure 15:
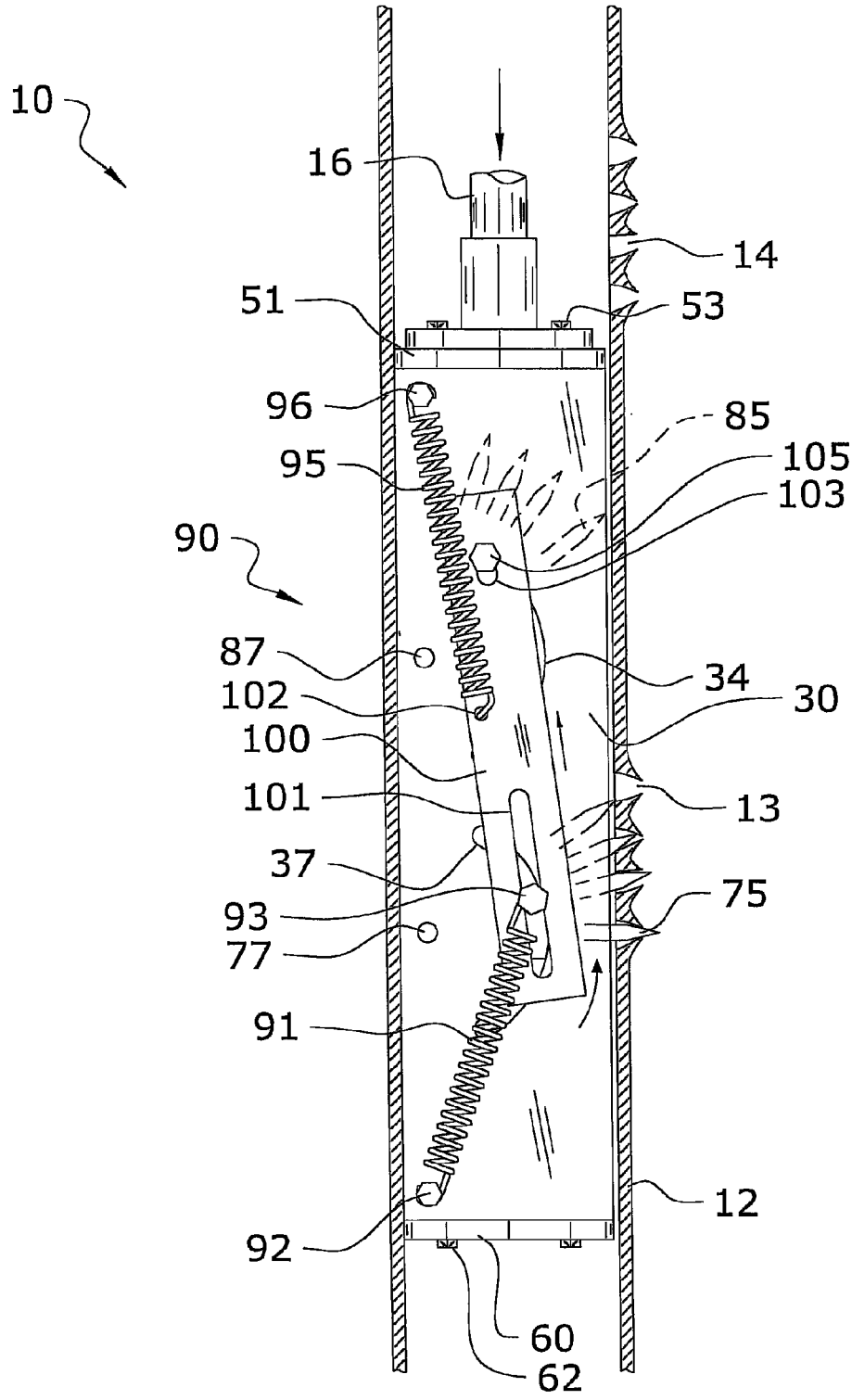
FIG. 15 is a side view of the alternate embodiment of the present invention using a drill rig and illustrating the downward directional force causing the lower perforator to form a second set of perforations in the well casing.
Figure 16:
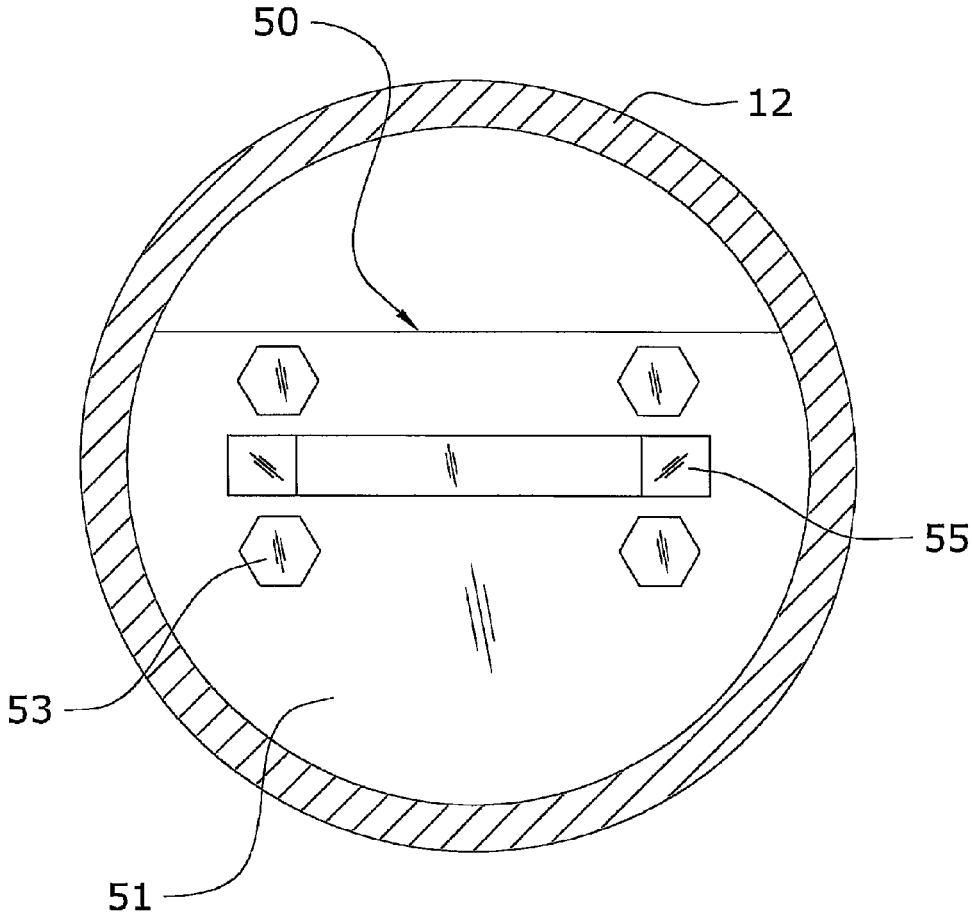
FIG. 16 is a top view of the present invention.

The elongated member 16 may be comprised of multiple devices or objects, such as rope or cable tied to a pulley system or winch as illustrated in FIGS. 1 through 13, a drop pipe attached to a drill rig as illustrated in FIGS. 14 and 15, or various other structures. In the case of the drop pipe, the connector element 55 and opening 56 generally threadably receive the drop pipe. The drop pipe or other type of elongated member 16 may be used to vertically push and/or pull or rotate the frame 20 within the well casing 12.

The lower support 60 is comprised of a plate structure and includes a plurality of openings 61 extending therethrough for receiving the fasteners 62 that secure the lower support 60 to the lower openings of the first side plate 30 and the second side plate 40.

C. Perforators

The perforators 70, 80 are pivotally connected to the frame 20 within the space between the first side plate 30 and the second side plate 40. In the preferred embodiment, the present invention includes a lower perforator 70 and an upper perforator 80 mechanically connected to each other. The lower perforator 70 and the upper perforator 80 work in a sequential manner when perforating the well casing 12. The lower perforator 70 and the upper perforator 80 are also preferably positioned above and below each other. The perforators 70, 80 are designed to puncture the well casing 12 during either an upward or downward directional movement of the frame 20.

The perforators 70, 80 generally include a pivotal support 71, 81 that is pivotally connected to the frame 20. Each pivotal support 71, 81 includes a first opening 72, 82 and a second opening 73, 83. The first opening 72, 82 and the second opening 73, 83 are generally arranged along the longitudinal axis of the perforator 70, 80. The first opening 72, 82 aligns with the pivotal openings 33, 36, 42, 43 of the first side plate 30 and the second side plate 40, wherein a pin 77, 87 is extended therethrough for providing a pivotal support 71, 81 in which the perforator 70, 80 can pivot upon.

The second opening 73, 83, which is between the first opening 72, 82 and the spikes 75, 85, is aligned with a respective curved slot 34, 37. The second opening 73, 83 and respective slot 34, 37 receive a fastener 93, 105 for the perforator 70, 80 to move along and for mechanically connecting the perforators 70, 80 together via the linkage assembly 90 which will be described in the next section. The fasteners 93, 105 may threadably or slidably attach within the second openings 73, 83. The fasteners 93, 105 that are extended through the second openings 73, 83 and curved slots 34, 37 also preferably connect the springs 91, 95 to the linkage assembly 90 as will later be described in more detail.

Each of the perforators 70, 80 also include a plurality of spikes 75, 85 extending therefrom to resemble a four-fingered structure to extend past the slot and frame 20 and through the well casing 12. The spikes 75, 85 are elongated in structure and have a pointed end for puncturing the well casing 12 to create the perforations. The spikes 75, 85 are preferably removable from the pivotal supports 71, 81 to allow for the replacement of damaged or worn spikes 75, 85 if necessary. The spikes 75, 85 radially extend from the pivotal support 71, 81 and are each spaced apart along the outer curved perimeter of the pivotal support 71, 81 so that the outer end of the spikes 75, 85 form an arch.

Figure 17:
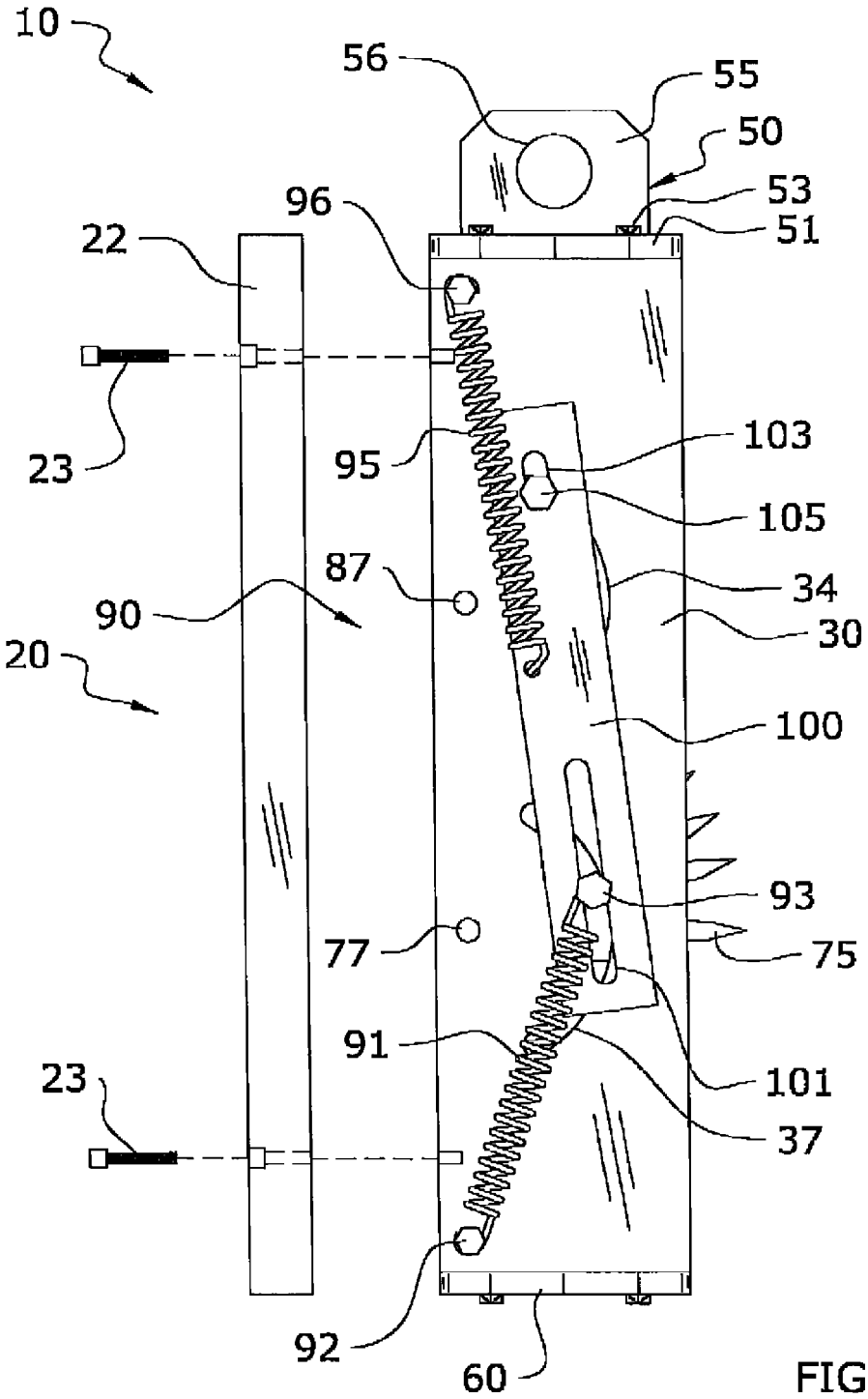
FIG. 17 is a side view of the present invention illustrating the spacer being added to increase the width of the present invention.

As illustrated in FIG. 17, a spacer 22 may also be fastened to the frame 20 via a fastener (e.g. bolt) to accommodate larger diameter well casings 12 so that the frame 20 is not able to vertically pivot while inserted within the well casing 12. The spacer 22 preferably includes a counter bore hole extending therethrough so that the head of the fastener is flush or inward of the exterior surface of the spacer 22.

D. Linkage Assembly

The linkage assembly 90 is used to mechanically connect the lower perforator 70 with the upper perforator 80 so that the perforators 70, 80 may operate in a sequential manner. The linkage assembly 90 generally includes a lower spring 91 and an upper spring 95. The lower spring 91 imparts a downward force upon the perforators 70, 80 and the upper spring 95 imparts an upward force upon the perforators 70, 80.

The lower spring 91 which is fixedly connected on one end to the opening 35 of the first side plate 30 via the fastener 92. The other end is movably within a slot 101 of an elongated connector 100, wherein the movably connected end of the spring 91 is also tied to the lower perforator 70 through the lower slot 101 via the fastener 93.

An upper spring 95 of the linkage assembly 90 is fixedly connected on one end to the opening 32 of the first side plate 30 via the fastener 96 and fixedly connected on an opposite end to an opening 102 of the elongated connector 100. It is appreciated that the lower spring 91 is movably connected with respect to the elongated connector 100 and frame 20 and the upper spring 95 is movably connected with respect to the frame 20. The upper spring 95 preferably has a stronger bias force than the lower spring 91 to overcome the force of the lower spring 91 and move the perforators 70, 80 back to start position when removed from the well casing 12.

The elongated connector 100 includes a lower slot 101 comprised of an elongated structure, the opening and a upper slot 103 comprised of a shorter elongated structure (than the lower slot 101) for receiving a fastener 105 extending through the upper curved slot 34 and connected to the upper perforator 80. The elongated connector 100 is generally comprised of a rectangular plate-like structure; however various configurations may be appreciated.

E. Operation of Preferred Embodiment

Figure 3:
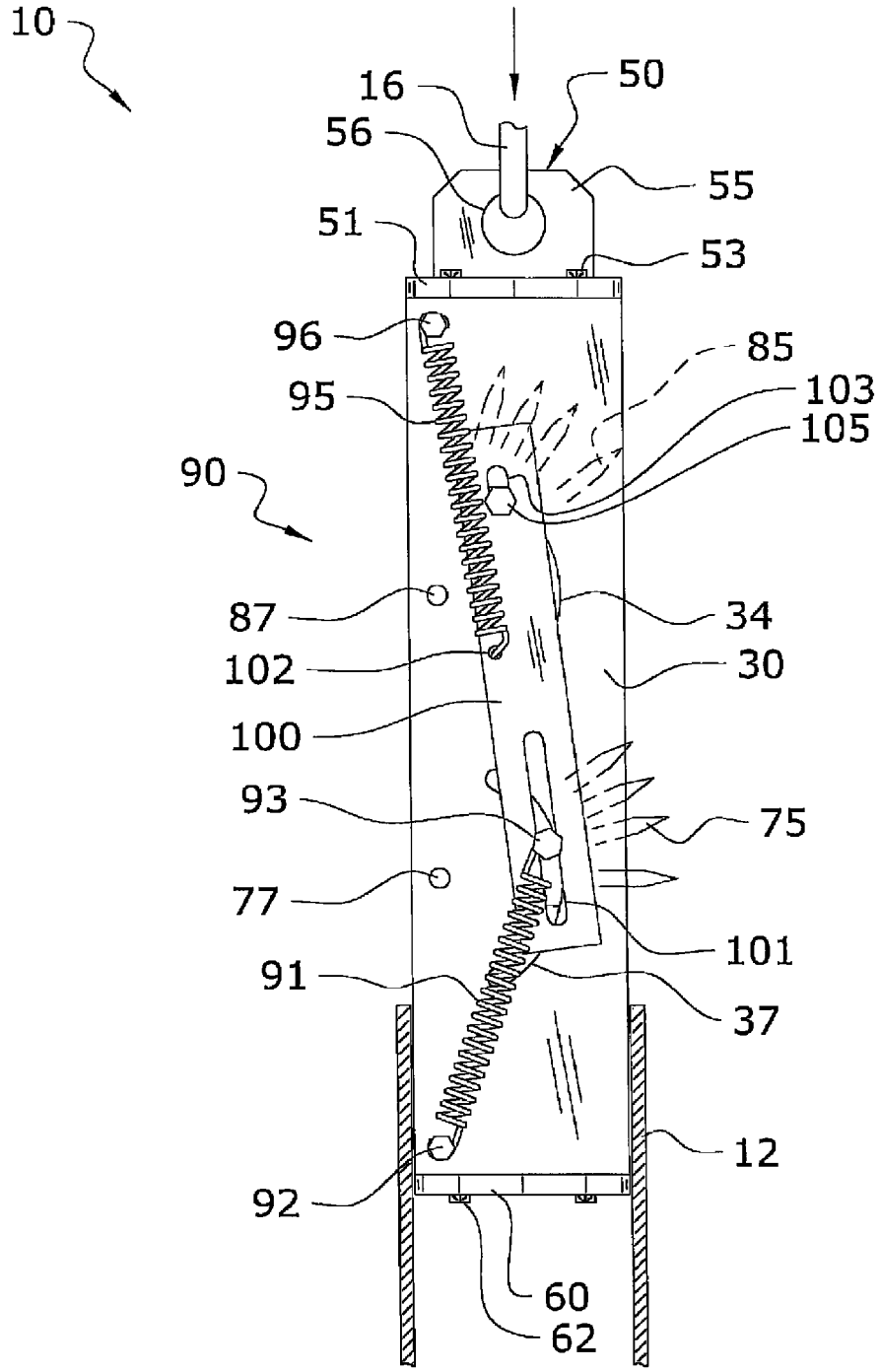
FIG. 3 is a side view of the present invention aligned with a well casing and illustrating the perforators in a start position.

In use, the assembled device 10 is lowered slowly into the well casing 12 with the lower support 60 facing down as illustrated in FIG. 3. During the start position, the spikes 74 of the lower perforator 70 extend beyond the well casing 12 and the spikes 85 of the upper perforator 80 face an upward position. The force of the upper spring 95 automatically moves the perforators 70, 80 into the start position when removed from the well casing 12.

As the frame 20 is lowered within the well casing 12, so that the lower perforator 70 is within the well casing 12, the lower perforator 70 is rotated into an up position with the spikes 75 facing upwards via the spikes 75 engaging the inside surface of the well casing 12. The lowermost spike of the plurality of spikes 75 slides along the interior wall of the well casing 12 via the lower spring 91 applying a bias force upon the lower perforator 70. When the lower perforator 70 faces upwards, the lower spring 91 is in an extended position.

Figure 4:
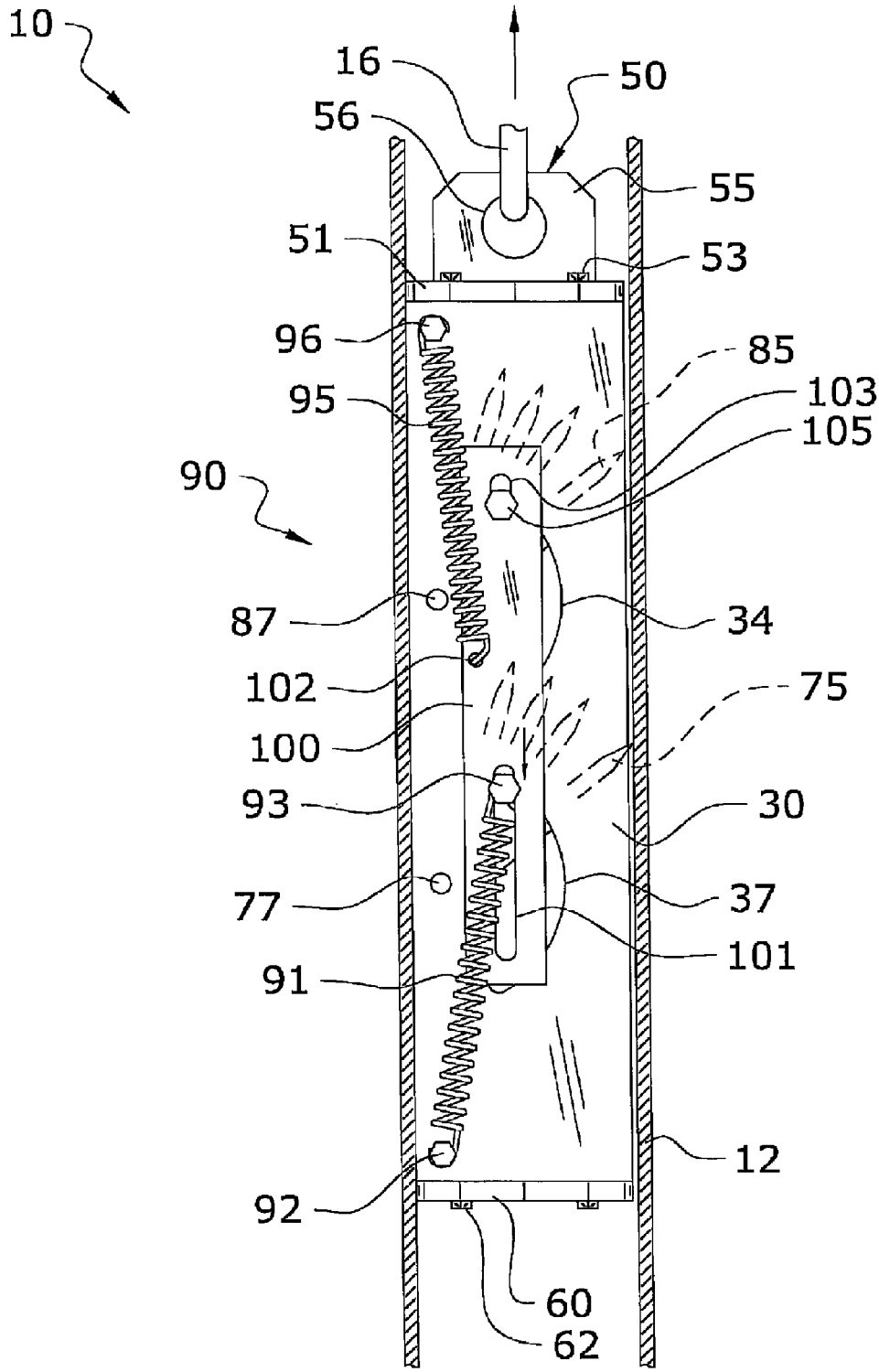
FIG. 4 is a side view of the present invention inserted within a well casing and illustrating an upward directional force being imparted upon the present invention.

The downward force applied upon the lower perforator 70 is crucial to ensure that the lower perforator 70 is able to grab upon the interior wall of the well casing 12 when an upward directional movement is applied to the frame 20 as shown in FIG. 4. The lowermost spike of the plurality of spikes 85 of the upper perforator 80 may also be sliding along the interior wall of the well casing 12 when within the well casing 12 via the force of the lower spring 91.

Once the perforators 70, 80 are at a suitable depth in which the well casing 12 is to be perforated, an upward force is exerted upon the elongated member 16 which subsequently moves the frame 20 upward as well. It is appreciated that the desired depth may be marked upon the elongated member 16 in the form of witness marks to help the operator determine when the perforators 70, 80 are at the desired depth.

Figure 5:
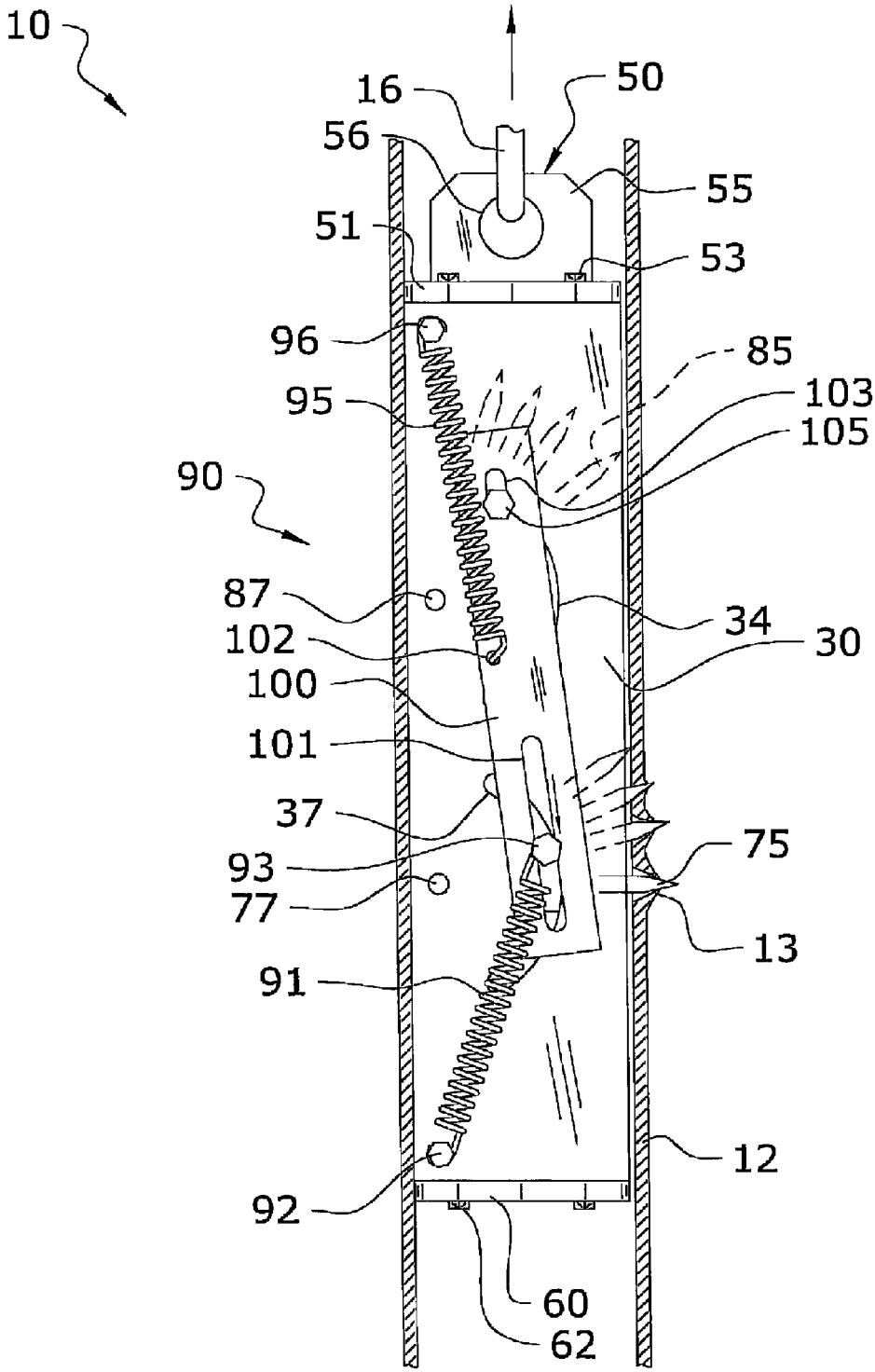
FIG. 5 is a side view of the present invention inserted within a well casing and illustrating the upward directional force causing the lower perforator to form a first set of perforations in the well casing.

When an upward or opposite directional movement is applied to the frame 20 as shown in FIG. 4, the lowermost spike of the plurality of spikes 75 of the lower perforator 70 grabs on the interior wall of the well casing 12 which forces the lower perforator 70 to rotate and the fastener to move downward within the lower curved slot 37 and the spikes of the plurality of spikes 75 to sequentially puncture the well casing 12 forming the perforations as the frame 20 is pulled upwards as illustrated in FIG. 5. The spikes rotate through the well casing 12 forming the perforations.

Figure 6:
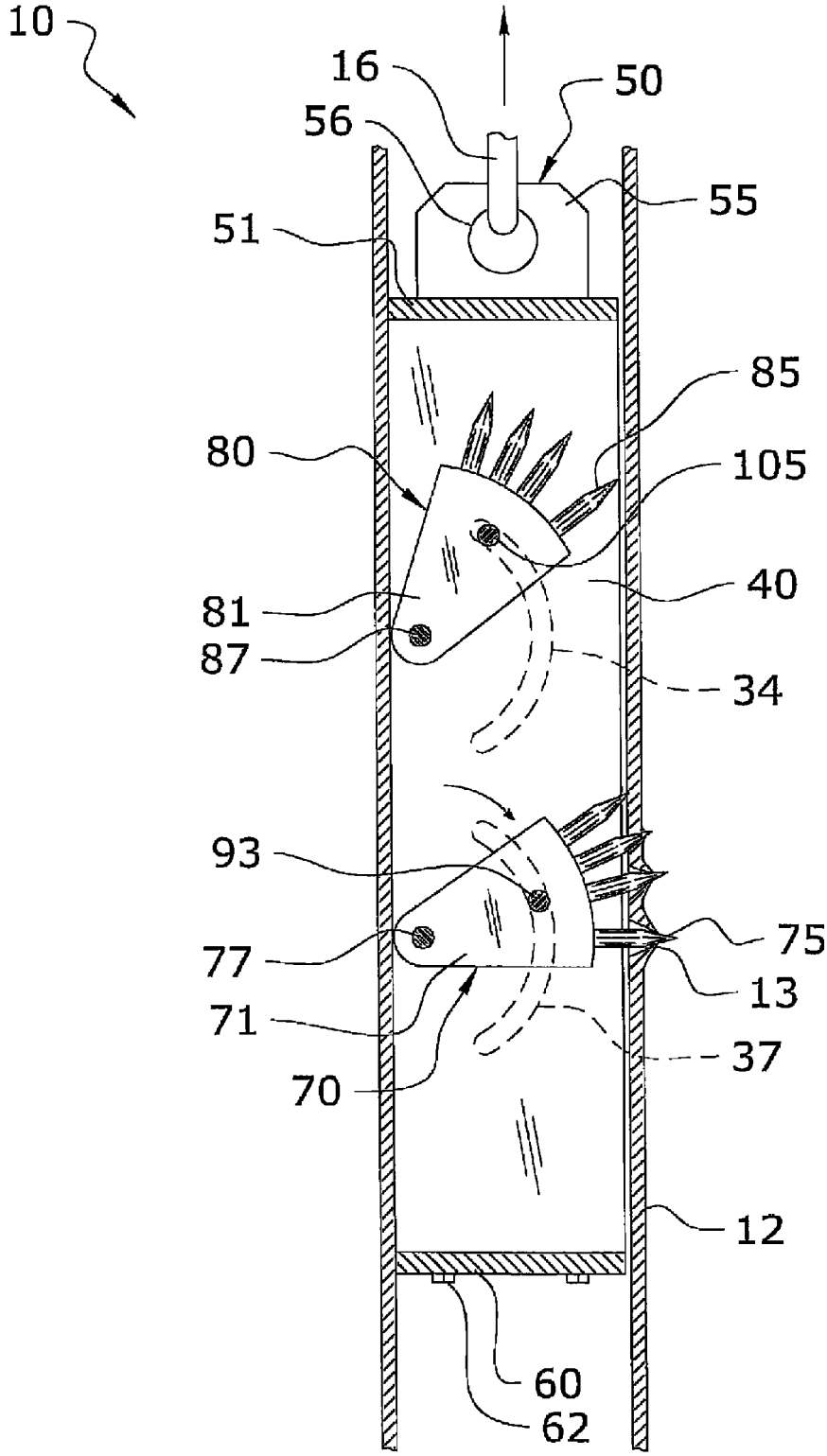
FIG. 6 is a sectional view of FIG. 5 illustrating the position of the perforators.

As the fastener is moved downward through the lower curved slot 37, the fastener 93 also travels downward within the lower slot 101 of the elongated connector 100 as shown in FIGS. 5 and 6. This causes the lower spring 91 to retract and the upper spring 95 to expand. As the frame 20 is continued to be pulled upward, the fastener eventually reaches the lowermost point of the lower curved slot of the frame 20 and the lower slot 101 of the elongated connector 100, wherein the lower spring 91 is then in a fully retracted position. The elongated slot 101 helps in delaying the contact of the lowermost spike of the upper spikes 85 until all of the lower spikes 75 on the lower perforator 70 have penetrated the casing 12. The delay is used to avoid an excessive load on the casing 12 by having all of the spikes 75, 85 penetrating the casing 12 at the same time.

Figure 7:
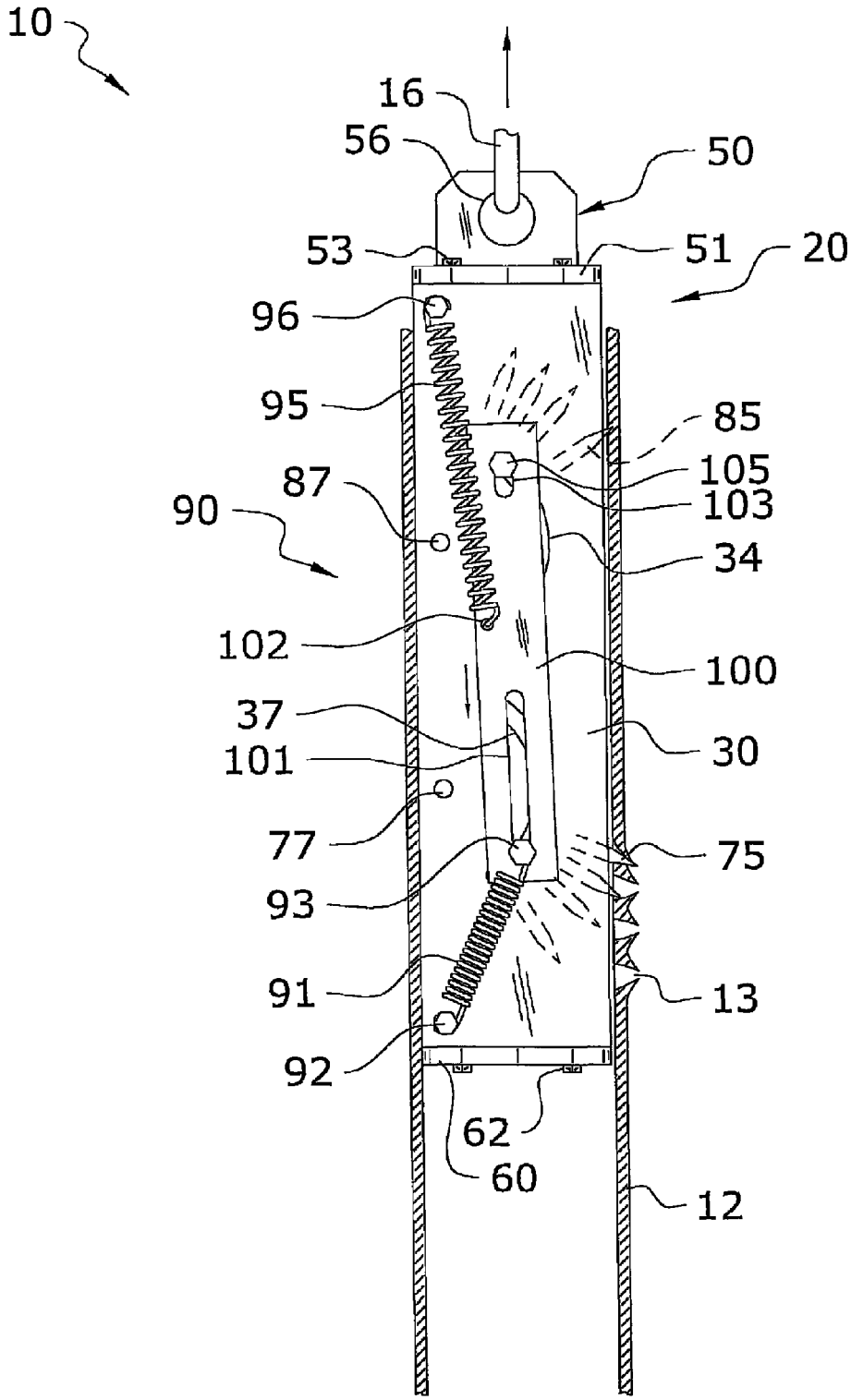
FIG. 7 is a side view of the present invention inserted within a well casing and illustrating the upward directional force causing the upper perforator to grab the well casing.
Figure 8:
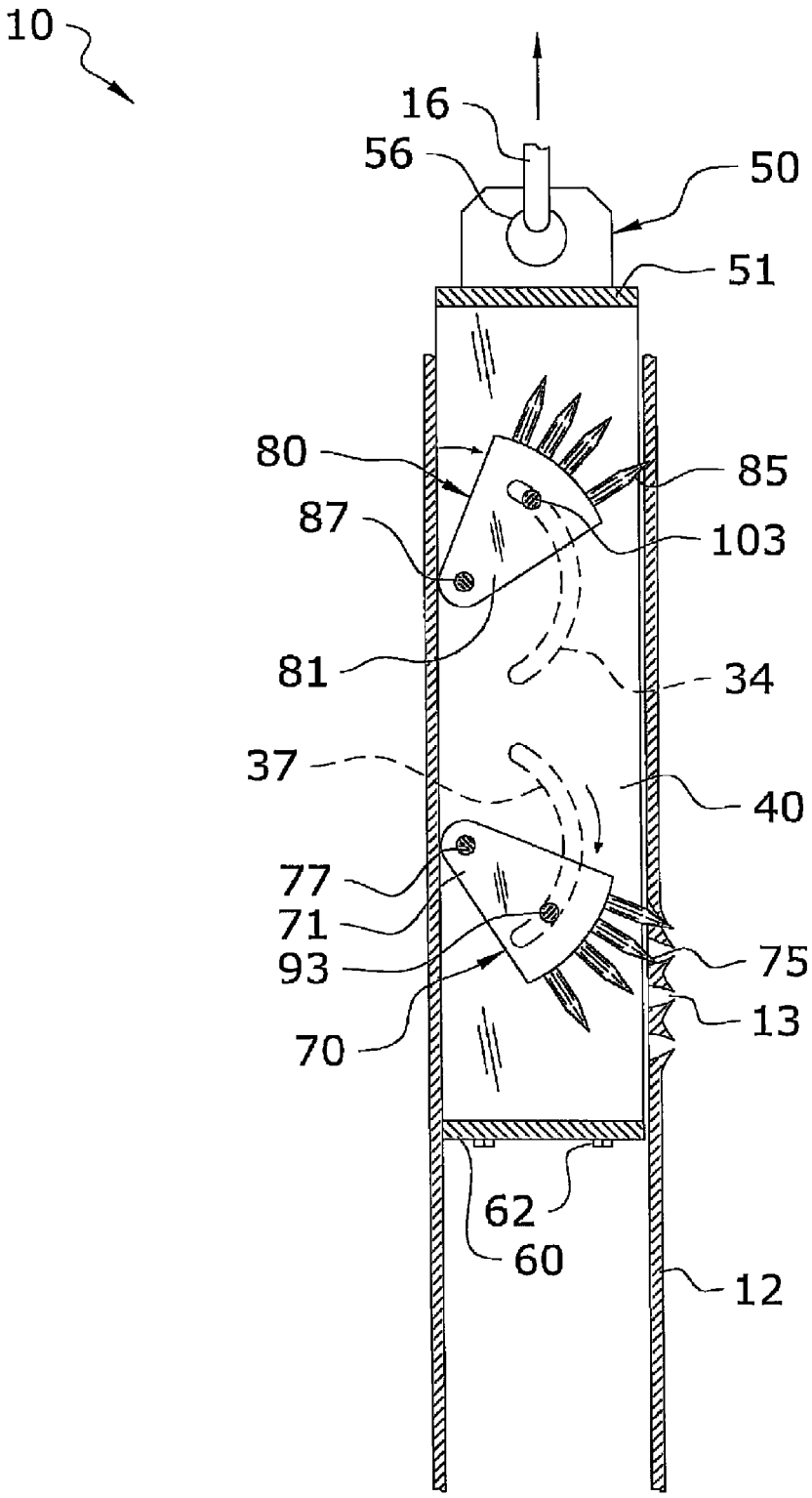
FIG. 8 is a sectional view of FIG. 7 illustrating the position of the perforators.
Figure 9:
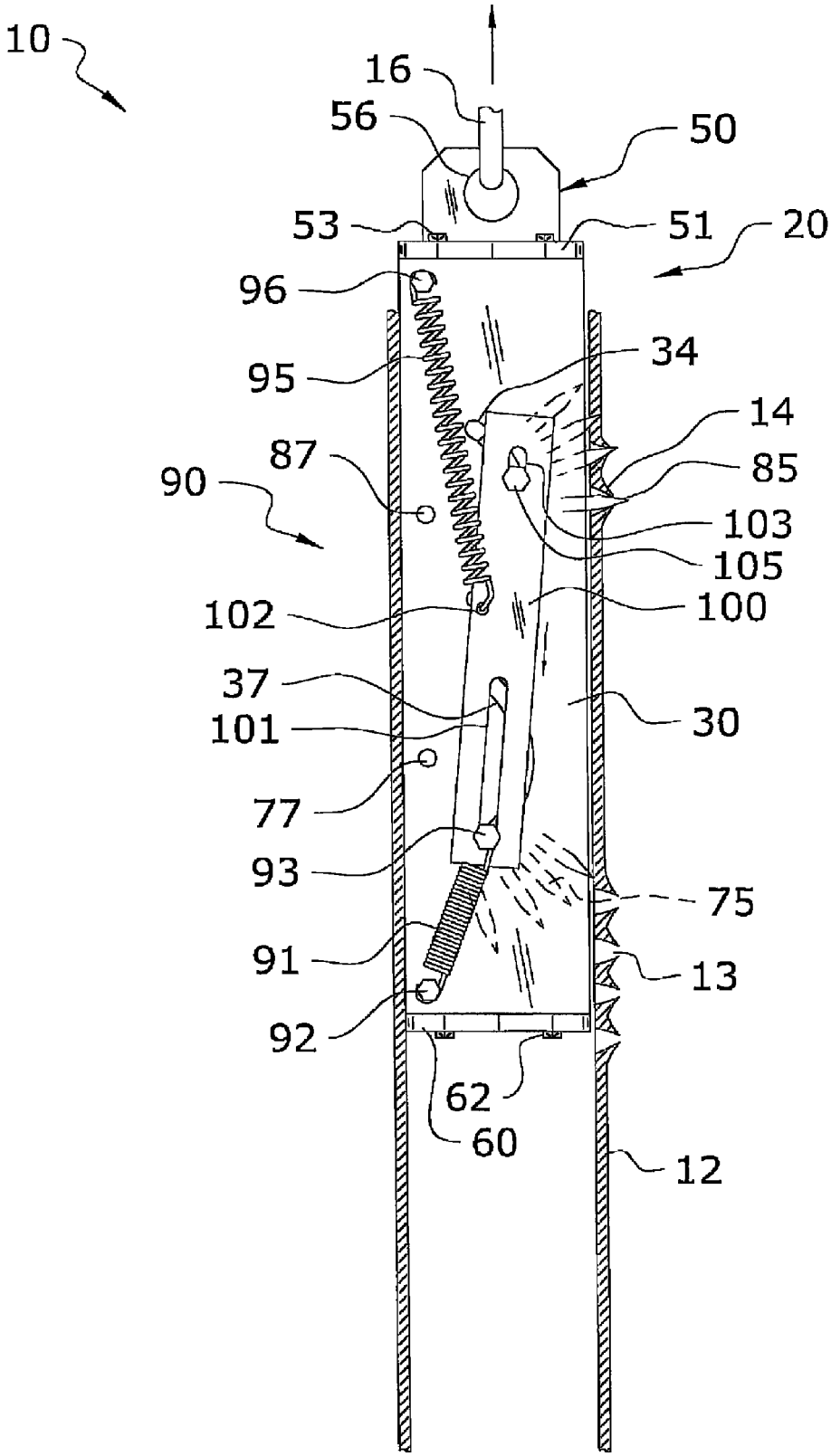
FIG. 9 is a side view of the present invention inserted within a well casing and illustrating the upward directional force causing the upper perforator to form a second set of perforations in the well casing.
Figure 10:
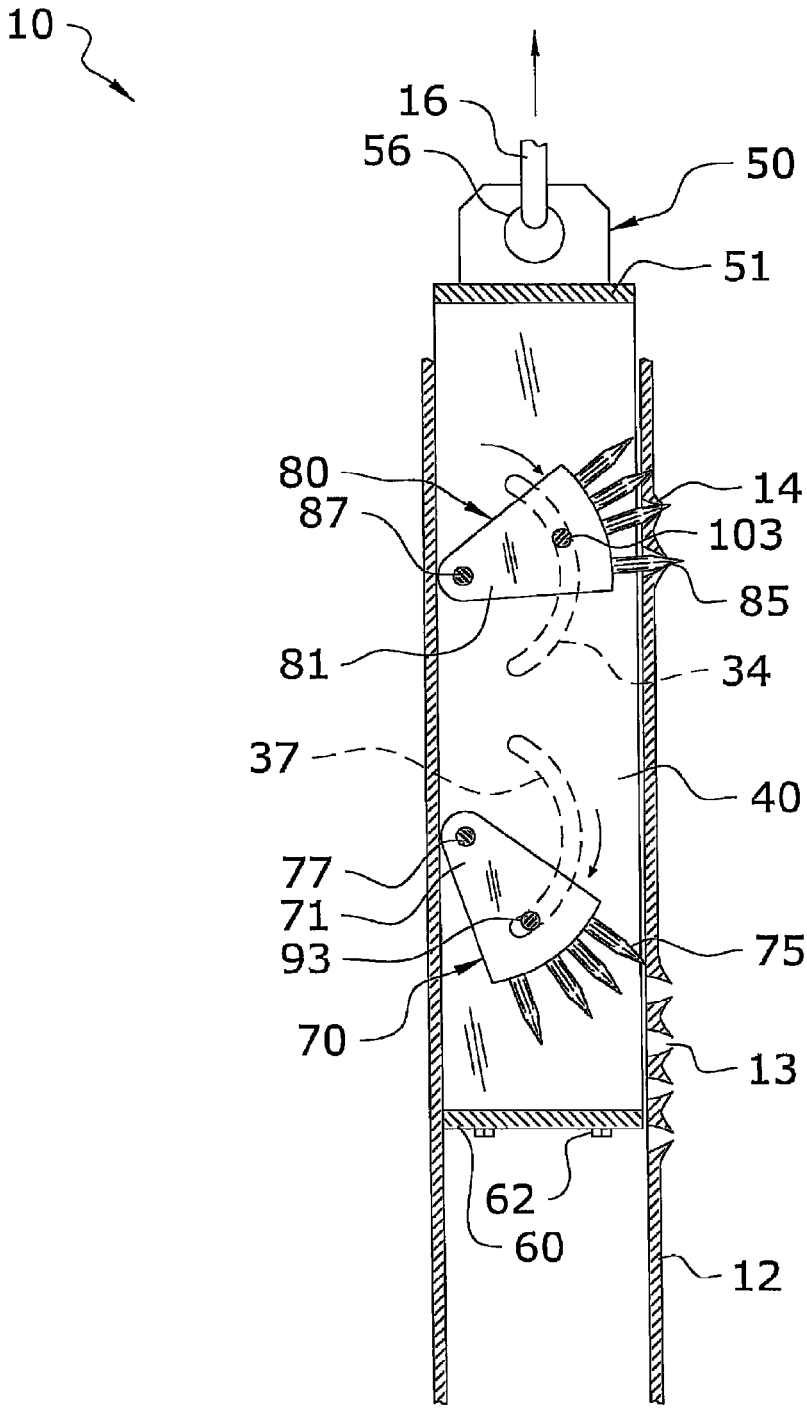
FIG. 10 is a sectional view of FIG. 9 illustrating the position of the perforators.
Figure 11:
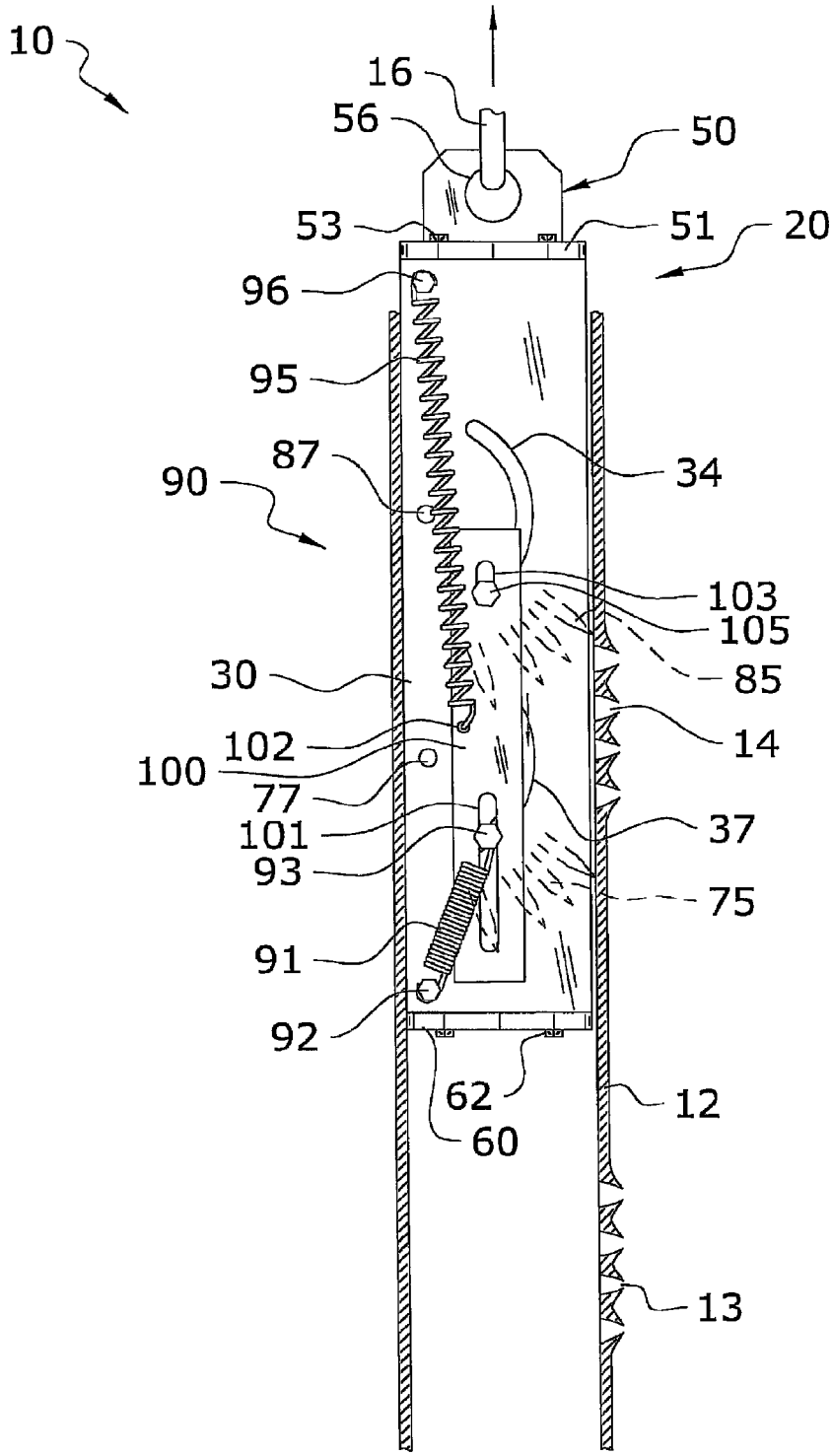
FIG. 11 is a side view of the present invention in a well casing after the perforations have been formed and showing the perforators both facing downward.
Figure 12:
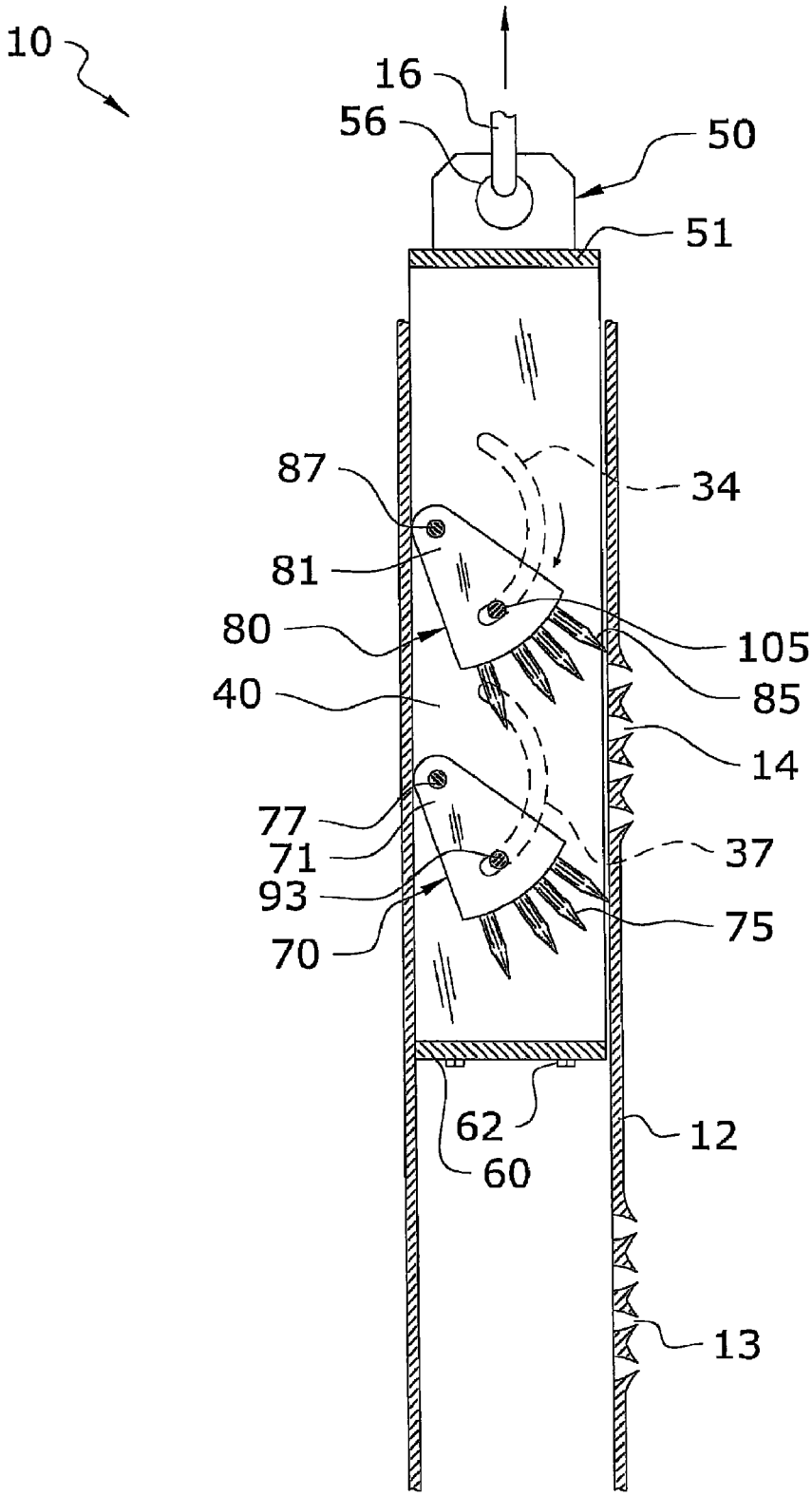
FIG. 12 is a sectional view of FIG. 11 illustrating the position of the perforators.
Figure 13:
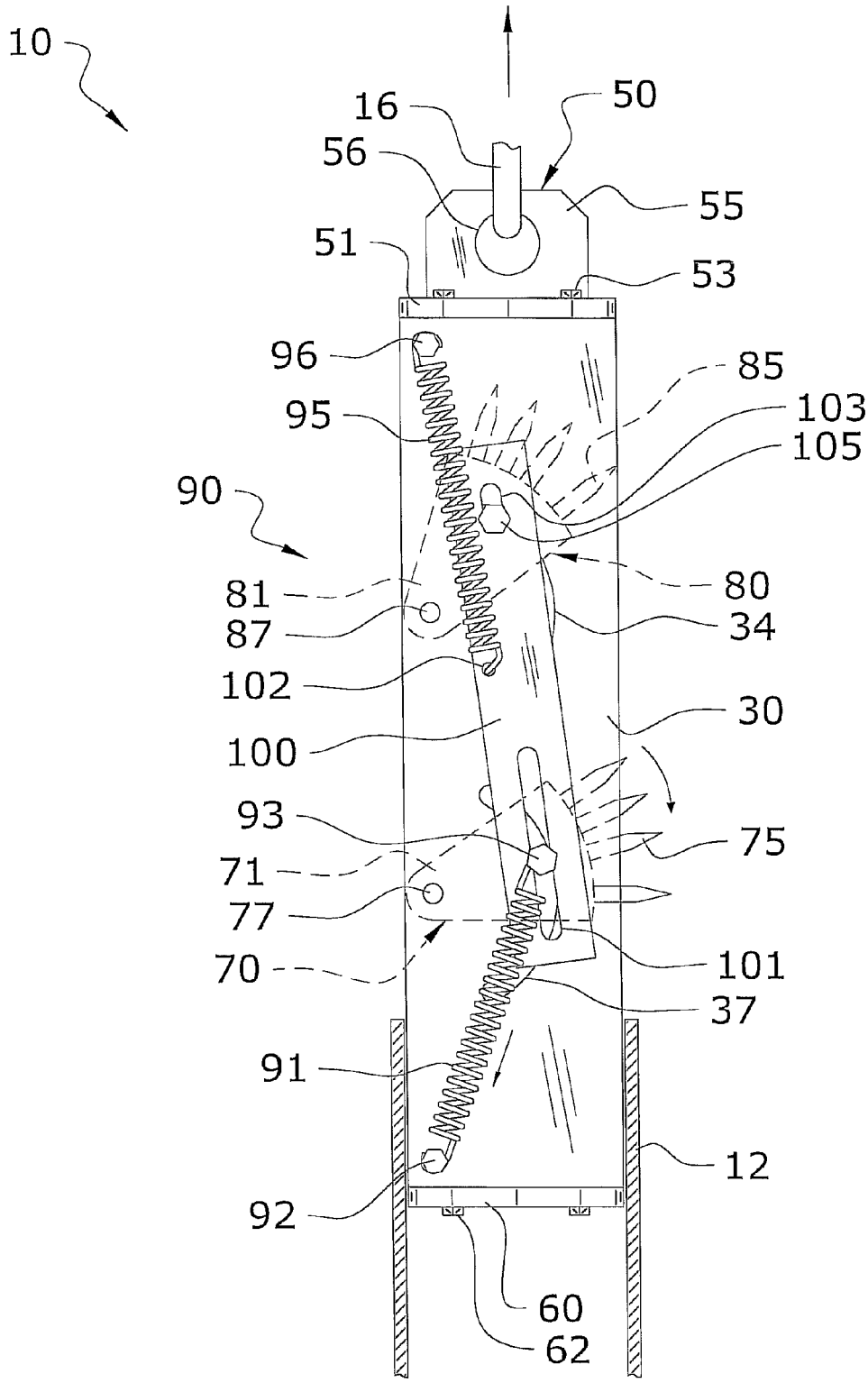
FIG. 13 is a side view of the present invention removed from a well casing and showing the perforators in the start position.

The uppermost spike of the plurality of spikes 75 of the lower perforator 70, being lodged in the well casing 12 as shown in FIGS. 7 and 8, causes the mechanically connected linkage 90 to pull down on the fastener 105 connecting the upper perforator 80 and expand the upper spring 95. As the fastener 105 is pulled downward the fastener 105 moves downward within the upper slot 103 causing the lowermost spike of the plurality of spikes 85 of the upper perforator 80 to grab the interior wall of the well casing 12 and pivot the upper perforator 80. The upper perforator 80 is subsequently rotated in a similar manner to the lower perforator 70 causing a second set of perforations 14 within the well casing 12 directly above the first set of perforations 13 caused by the lower perforator 70. The slot 103 is also slightly elongated to assist in making sure the upper perforator 80 was not engaged until the last perforation was made on the lower perforator 70.

Once the upper perforator 80 grabs and starts to rotate through the well casing 12, the lower perforator 70 is moved upward thus dislodging the upper perforator 80 from the well casing 12 so that the lower perforator 70 faces downward and is within the well casing 12. The frame 20 is continually pulled upwards until the upper perforator 80 is finished making the perforations, dislodges from the well casing 12 and faces downward similar to the lower perforator 70 as shown in FIGS. 9 through 12.

Since the force of the upper spring 95 is greater than the force of the lower spring 91, the upper most spike of the plurality of spikes 75, 85 of the upper perforator 80 and the lower perforator 70 is continually dragged along the interior wall of the well casing 12 while pulling the frame 20 upwards through the well casing 12.

If more perforations are desired to be made in the well casing 12, the directional movement of the frame 20 is simply changed as illustrated in FIGS. 14 and 15, which is appreciated can only be accomplished when using a rigid elongated member 16, such as a drop pipe or a drill rig. For instance, while pulling upwards on the frame 20 with the upper and lower perforators 70 facing downwards, the user simply needs to exert a downward force back upon the frame 20 to cause the frame 20 to switch directions and move downwards.

This causes the uppermost spike of the plurality of spikes 85 of the upper perforator 80 to grab on the well casing 12. The perforators 70, 80 then continue to make another first and second set of perforations 13, 14 in the well casing 12 in an opposite sequential manner as previously described with the upper perforator 80 first piercing the well casing 12 and then the lower perforator 70 piercing the well casing 12.

Likewise, when the directional movement of the frame 20 is again changed to bring the device 10 towards the top of the well casing 12, the perforators 70, 80 again pierce the well casing 12 starting with the lower perforator 70 and then the upper perforator 80. The user may also rotate the device to form perforations on a different side or angular direction of the well casing 12. If using the roper or winch as the elongated member 16, after perforating, it is necessary to return through the upper opening of the casing 12 to reset the perforators 70, 80 to the start position prior to reinsertion.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A device for perforating a well casing, comprising:

a frame adapted to be inserted within said well casing and move in a direction parallel to a central longitudinal axis of said well casing;

a lower perforator pivotally connected to said frame;

wherein said lower perforator includes a plurality of spikes extending therefrom for engagement with said well casing;

an upper perforator pivotally connected to said frame;

wherein said upper perforator includes a plurality of spikes extending therefrom for engagement with said well casing;

a lower spring connected to said frame on a first end and mechanically connected to said lower perforator and said upper perforator on a second end;

wherein said lower spring imparts a pivotal downward force upon said lower perforator and said upper perforator so that said plurality of spikes of said lower perforator and said upper perforator automatically grab said well casing and pivot through said well casing with a change in directional movement of said frame; and an upper spring connected to said frame on a first end and mechanically connected to said lower perforator and said upper perforator on a second end;

wherein said upper spring imparts a pivotal upward force upon said lower perforator and said upper perforator so that said plurality of spikes of said lower perforator and said upper perforator automatically grab said well casing and pivot through said well casing with a change in directional movement of said frame.

2. The well casing perforator of claim 1, wherein said upper spring imparts a greater force upon said upper perforator and said lower perforator than said lower spring.

3. The well casing perforator of claim 1, including a linkage assembly to mechanically connect said upper perforator to said lower perforator.

4. The well casing perforator of claim 3, wherein said upper perforator and said lower perforator operate in a sequential manner.

5. The well casing perforator of claim 1, wherein said upper perforator and said lower perforator are comprised of similar structures.

6. The well casing perforator of claim 1, wherein said plurality of spikes of said lower perforator and said upper perforator are each comprised of an elongated structure.

7. The well casing perforator of claim 1, wherein said plurality of spikes of said lower perforator and said upper perforator form an arched configuration.

8. The well casing perforator of claim 1, wherein said frame includes a lower curved slot for pivotal movement of said lower perforator and an upper curved slot for pivotal movement of said upper perforator.

9. The well casing perforator of claim 1, including a spacer adapted to connect to said frame for widening said frame.

10. A device for perforating a well casing, comprising:

a frame adapted to be inserted within said well casing and move in a direction parallel to a central longitudinal axis of said well casing;

wherein said frame includes a first side plate, a second side plate, an upper support and a lower support;

wherein said first side plate is spaced apart from said second side plate;

wherein said first side plate includes a lower curved slot and an upper curved slot;

wherein said upper support connects an upper end of said first side plate and said second side plate;

wherein said lower support connects a lower end of said first side plate and said second side plate;

wherein said upper support includes a connecting element to connect to an elongated member for vertically moving said frame within said well casing;

a lower perforator pivotally connected to said frame between said first side plate and said second side plate;

wherein said lower perforator includes a plurality of lower spikes extending therefrom for engagement with said well casing;

wherein said plurality of lower spikes are each comprised of an elongated structure;

wherein said plurality of lower spikes form an arch shaped configuration;

an upper perforator pivotally connected to said frame between said first side plate and said second side plate;

wherein said upper perforator includes a plurality of upper spikes extending therefrom for engagement with said well casing;

wherein said plurality of upper spikes are each comprised of an elongated structure;

wherein said plurality of upper spikes form an arch shaped configuration; and a linkage assembly to mechanically connect said upper perforator to said lower perforator so that said upper perforator and said lower perforator operate in a sequential manner;

wherein said linkage assembly includes a lower spring, an upper spring and an elongated connector;

wherein said elongated connector includes a lower slot and an upper slot;

wherein said lower slot aligns with said lower curved slot of said first side plate and wherein said upper slot aligns with said upper curved slot of said first side plate;

wherein said lower perforator is pivotally moved along said lower curved slot and wherein said upper perforator is pivotally moved along said upper curved slot;

wherein said lower spring is connected to a lower end of said frame on a first end and mechanically connected to said lower perforator and said upper perforator on a second end;

wherein said second end of said lower spring moves within said lower slot of said elongated connector;

wherein said lower spring imparts a pivotal downward force upon said lower perforator and said upper perforator so that said plurality of spikes of said lower perforator and said upper perforator automatically grab said well casing and pivot through said well casing with a change in directional movement of said frame;

wherein said upper spring is connected to an upper end of said frame on a first end and mechanically connected to said lower perforator and said upper perforator on a second end;

wherein said second end of said upper spring is fixedly connected to said elongated connector;

wherein said upper spring imparts a greater force upon said upper perforator and said lower perforator than said lower spring;

wherein said upper spring imparts a pivotal upward force upon said lower perforator and said upper perforator so that said plurality of spikes of said lower perforator and said upper perforator automatically grab said well casing and pivot through said well casing with a change in directional movement of said frame.

* * * * *